US009914020B2

(12) United States Patent
Sato

(10) Patent No.: US 9,914,020 B2
(45) Date of Patent: Mar. 13, 2018

(54) GOLF BALL HAVING OVAL DIMPLES

(71) Applicant: BRIDGESTONE SPORTS CO., LTD., Tokyo (JP)

(72) Inventor: Katsunori Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 15/278,509

(22) Filed: Sep. 28, 2016

(65) Prior Publication Data

US 2017/0014685 A1 Jan. 19, 2017

Related U.S. Application Data

(63) Continuation-in-part of application No. 14/751,220, filed on Jun. 26, 2015, now Pat. No. 9,474,940.

(30) Foreign Application Priority Data

Jun. 27, 2014 (JP) ..... 2014-132372

(51) Int. Cl.
*A63B 37/06* (2006.01)
*A63B 37/00* (2006.01)

(52) U.S. Cl.
CPC ..... *A63B 37/0008* (2013.01); *A63B 37/002* (2013.01); *A63B 37/0006* (2013.01);
(Continued)

(58) Field of Classification Search
CPC ..... A63B 37/0012; A63B 37/0003
(Continued)

(56) References Cited

U.S. PATENT DOCUMENTS 4,284,276 A 8/1981 Worst
4,869,512 A 9/1989 Nomura et al.
(Continued)

FOREIGN PATENT DOCUMENTS

JP 8-191905 A 7/1996
JP 2012-130603 A 7/2012

*Primary Examiner* — Raeann Gorden
(74) *Attorney, Agent, or Firm* — Sughrue Mion, PLLC

(57) ABSTRACT

A golf ball includes oval dimples arranged on the surface thereof. Each of the oval dimples has a long diameter DL and a short diameter DS in a planar shape thereof and further having a depth DPL on a first cross section of the oval dimple along the long diameter DL and a depth DPS on a second cross section of the oval dimple along the short diameter DS, the depth DPL being a distance taken on the first cross section along the long diameter DL from a first line connecting both ends of the first cross section of the oval dimple to a deepest point of a dimple bottom surface, the depth DPS being a distance taken on the second cross section along the short diameter DS from a second line connecting both ends of the second cross section of the oval dimple to a deepest point of a dimple bottom surface, a relationship between the depth DPL and the depth DPS being defined as a following formula (1):

$$DPS > DPL \quad (1).$$

Each of the oval dimples further having a cross-sectional area DLA on the first cross section of the oval dimple along the long diameter DL and a cross-sectional area DSA on the second cross section of the oval dimple along the short diameter DS, the cross-sectional area DLA being surrounded by the first line connecting both ends of the first cross section of the oval dimple and the bottom surface thereof, the cross-sectional area DSA being surrounded by the second line connecting both ends of the second cross section of the oval dimple and the bottom surface thereof, a relationship
(Continued)

between the cross-sectional area DLA and the cross-sectional area DSA being defined as a following formula (2):

$$DLA \geq DSA \quad (2).$$

10 Claims, 5 Drawing Sheets

(52) U.S. Cl.
CPC ..... *A63B 37/0012* (2013.01); *A63B 37/0016* (2013.01); *A63B 37/0017* (2013.01); *A63B 37/0019* (2013.01); *A63B 37/0021* (2013.01); *A63B 37/0062* (2013.01); *A63B 37/0064* (2013.01); *A63B 37/0074* (2013.01); *A63B 37/0076* (2013.01)

(58) Field of Classification Search
USPC ..... 473/383
See application file for complete search history.

(56) References Cited

U.S. PATENT DOCUMENTS

| | | | | |
|---|---|---|---|---|
| 5,356,150 | A | 10/1994 | Lavallee et al. | |
| 5,722,903 | A | 3/1998 | Moriyama et al. | |
| 6,176,793 | B1 * | 1/2001 | Sullivan ..... | A63B 37/0004 473/351 |
| 6,206,792 | B1 | 3/2001 | Tavares et al. | |
| 7,229,363 | B2 | 6/2007 | Kasashima | |

* cited by examiner

GOLF BALL HAVING OVAL DIMPLES

CROSS-REFERENCE TO RELATED APPLICATION

This Application is a continuation-in-part of U.S. patent application Ser. No. 14/751,220 filed Jun. 26, 2015, in the U.S. Patent and Trademark Office, which claims priority from Japanese Patent Application No. 2014-132372 filed Jun. 27, 2014, which are incorporated herein by reference in their entirety.

BACKGROUND OF THE INVENTION

The present invention relates to a golf ball having oval dimples.

It is well known that in designing golf balls, in order to design a golf ball that travels a long flight distance when it is hit, it is important that the golf ball itself have a high resilience and that the air resistance applied during travel be reduced by dimples arranged on the surface of the golf ball.

For example, Japanese Patent Application Publication No. 08-191905 discloses a method intended to increase the flight distance by generating a large amount of turbulence in the air around the golf ball and decrease the difference in the flight distances between the distance travelled in the case of a hit at the pole and that travelled in the case of a hit at the seam, in which the golf ball includes dimples having a circular planar shape and non-circular elliptical dimples, the total number of the elliptical dimples is 20% or more of the total number of the dimples, and the dimples are arranged so that the average crossing acute angle δ between a line passing through the center of each elliptical dimple and the pole and the major axis of each such dimple satisfies $0 \leq \delta \leq 80°$.

In addition, Japanese Patent Application Publication No. 2012-130603 discloses a method intended to provide a golf ball capable of travelling a great flight distance when hit with a driver at a head speed of 45 to 55 m/s, in which a plurality of types of dimples of mutually different diameters is provided on the surface of the golf ball, the standard deviation of the radiuses of curvature on the cross section of all the dimples is 0.90 mm or less, the mean value of the radiuses of curvature on the cross section of all the dimples is 20 to 40% of the diameter of the golf ball, the total value of the volume of all the dimples is 300 to 370 $mm^3$, the mean value of the diameters of all the dimples is 3.5 to 4.5 mm, and the ratio of the total value of the areas of all the dimples in relation to the surface area of the virtual sphere of the golf ball is 75 to 95%.

SUMMARY OF THE INVENTION

In view of the techniques as discussed above, an object of the present invention is to provide a golf ball having oval dimples, capable of exhibiting excellent aerodynamic isotropy and excellently reduction in air resistance by forming the oval dimple shapes arranged on the surface of the golf ball.

In order to achieve the object, according to an aspect of the present invention, a golf ball includes oval dimples arranged on a surface thereof, each of the oval dimples having a long diameter DL and a short diameter DS in a planar shape thereof, a relationship between the long diameter and the short diameter being defined as a following formula (1):

$$DL \leq DS \times 1.2 \quad (1),$$

each of the oval dimples further having a cross-sectional area DLA on a first cross section of the oval dimple along the long diameter DL and a cross-sectional area DSA on a second cross section of the oval dimple along the short diameter DS, the cross-sectional area DLA being surrounded by a line connecting both ends of the first cross section of the oval dimple and a bottom surface thereof, the cross-sectional area DSA being surrounded by a line connecting both ends of the second cross section of the oval dimple and a bottom surface thereof, a relationship between the cross-sectional area DLA and the cross-sectional area DSA being defined by the following formula (2):

$$DLA \geq DSA \quad (2), \text{ and}$$

a surface coverage SR of all dimples on the surface of the golf ball being at least 70%.

The oval dimples may be arranged so that the long diameter of the oval dimple is in parallel or perpendicular to an equator of the golf ball. The short diameter DS of the oval dimples may be at least 3.7 mm. The bottom surface of the oval dimple on the first cross section along the long diameter DL may have an oval shape, and the bottom surface of the oval dimple on the second cross section along the short diameter DS may have a circular or parabola shape. A volume ratio VR of all dimples in the golf ball may be in a range of 0.85 to 1.7%.

A ratio of the number of the oval dimples to the total number of all dimples arranged on the golf ball may be at least 10%. At least one oval dimple may be arranged in a first range of latitude of 0 to 30°, a second range of latitude of 30 to 60°, and a third range of latitude of 60 to 90°, respectively, where 0° is taken as the equator of the golf ball.

As described above, according to the present invention, in the oval dimple, the relationship between the long diameter DL and the short diameter DS satisfies formula (1) mentioned above, the relationship between the cross-sectional area DLA along the long diameter DL and the cross-sectional area DSA along the short diameter DS satisfies formula (2) mentioned above, the surface coverage SR of all dimples on the golf ball is at least 70%, and thereby excellent aerodynamic isotropy can be exhibited and excellent reduction of air resistance can be achieved.

DESCRIPTION OF THE EMBODIMENTS

Embodiments of a golf ball having dimples with an oval planar shape according to the present invention will be described below with reference to attached drawings, but the present invention is not limited to these.

Figure 1:
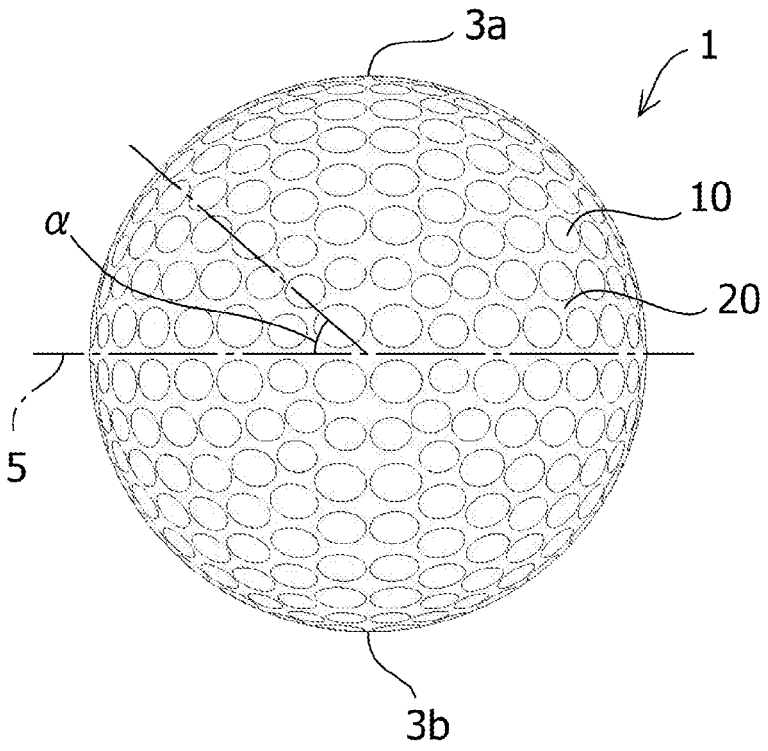
FIG. 1 is a front view showing an embodiment of a golf ball according to the present invention.

As shown in FIG. 1, a plurality of dimples 10 is formed on a surface of a golf ball 1 according to the present embodiment. A portion of the surface of the golf ball 1 in which no dimple 10 is formed will be referred to as a land portion 20. The golf ball 1 includes a north pole 3*a*, a south pole 3*b*, and an equator 5. The golf ball 1 is usually molded by using dies (not illustrated) constituted by two dies respectively and basically including hemispheric cavities. Poles 3 of the golf ball are formed at locations of an apex of two cavities. The equator 5 of the golf ball is formed at a location corresponding to a joint surface between the two dies.

The planar shape of the dimple 10 that is formed on the surface of the golf ball 1 (i.e., a shape of a boundary line between the dimple 10 and the land portion 20 viewed from a direction perpendicular to the dimple) may be one or more types of shapes. In the present invention, at least one of the plurality of types of shapes is an oval shape. In addition to the oval shape, a circular shape may be used. Further, the dimples 10 of the same shape such as the oval shape or the circular shape may differ from one another in terms of their dimensions. It is preferable to arrange at least three types of dimples of different shapes or dimensions. With this configuration, the dimples can be uniformly arranged on the spherical surface of the golf ball with no gap existing among them.

Figure 2:
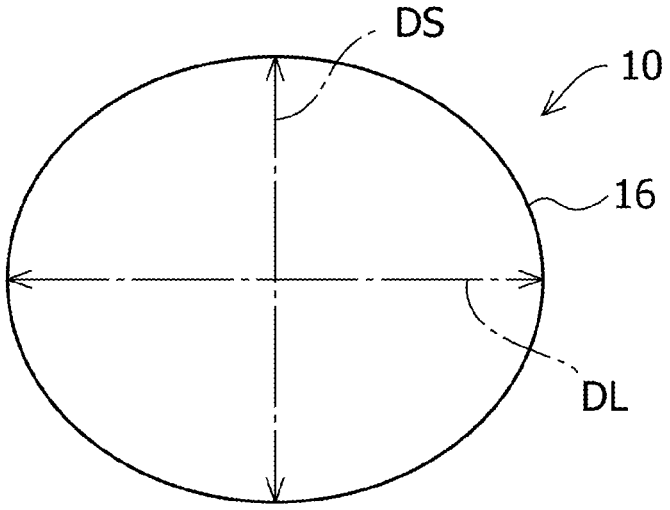
FIG. 2 is a magnified plan view of one dimple of the golf ball illustrated in FIG. 1.

As shown in FIG. 2, the oval dimple 10 is provided by an oval boundary line 16, which includes a long diameter DL and a short diameter DS. In the present invention, as one of the characteristics thereof, a relationship between the long diameter DL and the short diameter DS of the oval shape satisfies the following formula (1).

$$DL \leq DS \times 1.2 \quad (1)$$

As described above, it is necessary that the long diameter DL be longer than the short diameter DS by 1.2 times or less. In particular, it is preferable that the long diameter DL be shorter than a length longer than the short diameter DS by 1.15 times, and it is more preferable that the long diameter DL be shorter than a length longer than the short diameter DS by 1.10 times. On the other hand, the length of the long diameter DL is not limited to a specific lower limit as long as it is longer than the short diameter DS; however, it is preferable that the long diameter DL be longer than the short diameter DS by 1.01 times or more, more preferably by 1.05 times or more, and yet more preferably by 1.1 times or more.

The lower limit of the dimension of the short diameter DS is preferably 3.7 mm or longer. As described above, by arranging the oval dimples with the short diameters DS having dimensions of greater than 3.7 mm, a ratio of occupation of the dimples on the surface (a dimple surface occupation ratio SR) can be easily maintained at 70% or higher. The lower limit of the short diameter DS is preferably 3.9 mm or longer, and more preferably 4.1 mm or longer. On the other hand, the dimension of the short diameter DS is not limited to a specific upper limit, and it is preferable that the short diameter DS be 6 mm or shorter, more preferably 5.5 mm or shorter, and yet more preferably 5 mm or shorter. Note that it is not required for all the dimples formed on the surface of the golf ball to have a specific dimension and the oval shape described above. It is preferable that the ratio of the number of the dimples having the specific dimension and the oval shape to the total number of the oval dimples be 50% or higher, more preferably 70% or higher, and yet more preferably 90% or higher.

Figure 3:
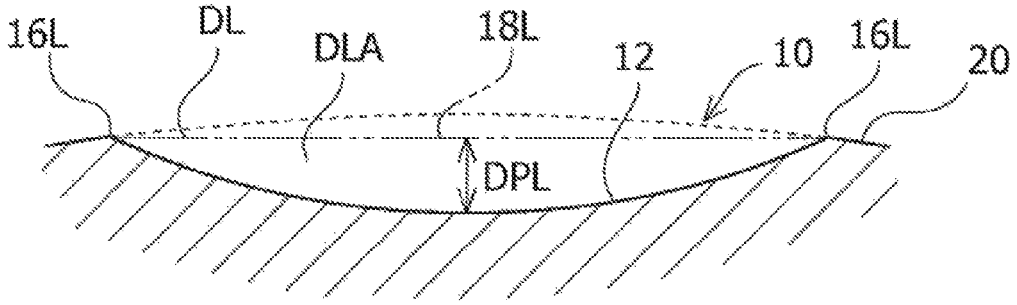
FIG. 3 is a cross sectional view along a long diameter DL of the dimple illustrated in FIG. 2.

As shown in FIG. 3, the oval dimple 10 includes a dimple bottom surface 12 formed on a cross section along the long diameter DL and having a depth DPL. The depth DPL is a distance taken on the cross section along the long diameter DL from a reference line 18L, which is a line connecting two boundary points 16L between the dimple 10 and the land portion 20 (i.e., both ends 16L of the dimple), to a deepest point of the dimple bottom surface 12. The shape of the dimple bottom surface 12 is preferably an oval arc shape. However, the shape of the dimple bottom surface 12 is not limited to this, and any shape with which the following formula (2) is satisfied can be used. The oval dimple 10 has a cross-sectional area DLA, which is an area of the portion surrounded by the line 18L that connects both ends of the dimple and the dimple bottom surface 12, on the cross section along the long diameter DL.

Note that if the shape of the dimple bottom surface is an oval arc shape, the cross-sectional area DLA can be calculated by the following formula.

$$DLA = (\pi \times DL/2 \times DPL)/2$$

Figure 4:
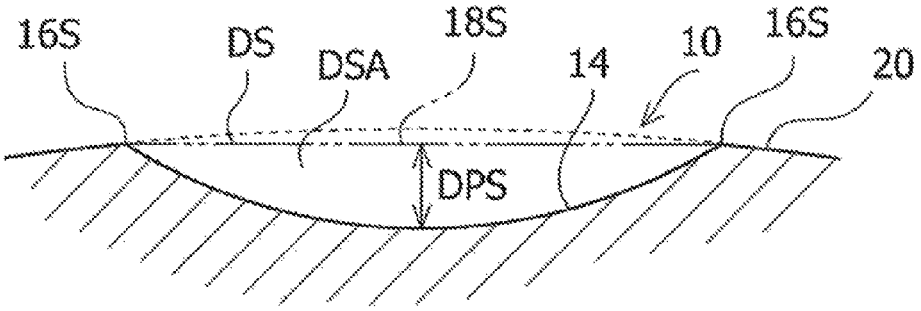
FIG. 4 is a cross sectional view along a short diameter DS of the dimple illustrated in FIG. 2.

As shown in FIG. 4, the oval dimple 10 includes a dimple bottom surface 14 and a depth DPS on the cross section along the short diameter DS. The depth DPS is a distance taken on the cross section along the short diameter DS from a reference line 18S, which is a line connecting two boundary points 16S between the dimple 10 and the land portion 20 (i.e., both ends 16S of the dimple), to a deepest point of the dimple bottom surface 14. The shape of the dimple bottom surface 14 on the cross section along the short diameter DS is preferably a circular arc shape or a parabola shape. However, the shape of it is not limited to these specific shapes, and any shape with which the following formula (2) is satisfied can be used. The dimple 10 has a cross-sectional area DSA, which is surrounded by the line 18S connecting both ends of the dimple and the dimple bottom surface 14 on the cross section along the short diameter DS.

The cross-sectional area DSA can be calculated by the following formula if the dimple bottom surface has a circular arc shape.

$$DSA = (rl - DS(r - DPL)/2$$

where r denotes the radius r of the circle and l denotes the length of the dimple bottom surface.

If the shape of the dimple bottom surface is a parabola shape, the cross-sectional area DSA can be calculated by the following formula.

$$DSA = DS \times DPL \times 2/3$$

In the present invention, as one of the characteristics thereof, a relationship between the cross-sectional area DLA along the long diameter DL and the cross-sectional area DSA along the short diameter DS satisfies the following formula (2).

$$DLA \geq DSA \quad (2)$$

As described above, it is necessary to design the planar shape and the bottom surface shape of the dimple so that the cross-sectional area DLA along the long diameter DL is greater than the cross-sectional area DSA along the short diameter DS. Note that in FIGS. 3 and 4, the boundary points 16L and 16S between the dimple bottom surfaces 12 and 14 and the land portion 20 have an angular shape; however, alternatively, the boundary points 16L and 16S may have a rounded shape. In this case also, the similar relationship of the cross-sectional area can be achieved if the tangent of the rounded portion is taken on the reference lines 18L and 18S.

In the present invention, as one of the characteristics thereof, the dimple 10 is arranged so that the long diameter DL is in parallel to the equator 5 of the golf ball 1 as illustrated in FIGS. 1 and 5 to 7 or perpendicular thereto as illustrated in FIGS. 8 to 11. The arrangement of the dimples 10 in which the long diameter of the oval shape is in parallel or perpendicular to the equator as described above is not required for all the oval dimples formed on the surface of the golf ball. Specifically, the ratio of the number of oval dimples arranged as described above to the total number of the oval dimples provided on the surface of the golf ball is preferably 10% or higher, more preferably 20% or higher, and yet more preferably 30% or higher. To paraphrase this, the dimples 10 may include dimples arranged so that the long diameter of the oval shape is neither in parallel nor perpendicular to the equator. In addition, the paralleled arrangement and the perpendicular arrangement can be used in combination. Furthermore, if the arrangement in which the long diameter of the oval shape is in parallel or perpendicular to the equator is employed, oval dimples may be arranged on the equator as illustrated in FIGS. 6, 7, 10, and 11.

Furthermore, in the present invention, as one of its characteristics, the surface coverage SR (i.e., a ratio of the total sum of surface areas of individual dimples, each defined by a flat plane circumscribed by an edge of the dimple, to the total surface area of a hypothetical spherical surface of the golf ball obtained by assuming that no dimple exists on the golf ball surface) is at least 70%. The dimple surface occupation ratio SR is a ratio of occupation of all the dimples formed on the surface of the golf ball including the oval dimples or other dimples that have shapes different from the oval shape. The surface coverage SR is preferably at least 71%, more preferably at least 72%. An upper limit of the surface coverage SR is preferably, but is not limited to, at most 90%.

A volume ratio VR (i.e., a ratio of the total sum of volumes of individual dimples, each defined by a space below a flat plane circumscribed by the boundary line of individual dimple on a golf ball to the volume of a hypothetical sphere of the golf ball obtained by assuming that no dimple exists on the golf ball surface) is preferably, but is not limited to, in the range of 0.85 to 1.7%.

It is not required for all the dimples formed on the surface of the golf ball to be dimples having the oval shape and the above-described four characteristics of the present invention. More specifically, it is preferable that the ratio of the dimples having the specific oval shape to a total number N of the dimples arranged on the surface of the golf ball be at least 10%, more preferably at least 20%, and even more preferably at least 30%.

An upper limit of the dimple total number N is preferably, but is not limited to, at most 500, more preferably at most 450. A lower limit of the dimple total number N is preferably, but is not limited to, at least 200, more preferably at least 250.

It is more preferable if at least one dimple having the oval shape discussed above be arranged within a range of 0 to 30° of a latitudinal angle α (where the angle of 0° is taken at the equator 5 and the angle of 90° is taken at the pole 3) of the golf ball 1, at least one dimple having the oval shape discussed above arranged within a range of 30 to 60° of the latitudinal angle α, and at least one dimple having the oval shape discussed above be arranged within a range of 60 to 90° of the latitudinal angle α, as illustrated in FIG. 1. By employing the oval dimple arrangements described above, the dimples having the oval shape discussed above can be arranged on the entire surface of the golf ball with good balance, and thereby, superior aerodynamic isotropy can be exhibited and the air resistance can be more effectively reduced.

The golf ball according to the present invention can be produced by using dies. In manufacturing such dies, a method which uses a 3-dimensional computer-aided design and manufacturing (3-D CAD/CAM) system and in which the shape of the entire surface is formed by directly and three-dimensionally shaving a reverse master die can be used, and also a method in which cavity portions are formed by directly and three-dimensionally shaving a molding die can be used. By designing the dies so that the parting line of the molds passes through the land portion on the surface of the golf ball, the golf ball can be easily finished (trimmed). In order to uniformly arrange the dimples on the spherical surface of the golf ball, it is preferable to use a method of polyhedral arrangement such as an icosahedral arrangement, a dodecahedral arrangement, or an octahedral arrangement, or a method of a rotational symmetry arrangement such as a threefold rotational symmetry arrangement, a fivefold rotational symmetry, or the like.

The golf ball according to the present invention may be a multi-piece solid golf ball, which has, arranged in order from the inside of the golf ball, a core, an envelope layer, and a cover layer. The core may have a two-layer construction consisting of an inner core layer and an outer core layer. The golf ball may have a number of layers than the four layers including the inner core layer, the outer core layer, the envelope layer encasing the core, and the cover layer encasing the envelope layer. The dimples are formed on the outer surface of the cover layer. Also, pieces or layers of the golf ball other than the core, i.e., the envelope layer and the cover layer, each has at least one layer and may be formed of, but is not limited to, a single layer or two or more layers.

As noted above, the core is formed in two layers: the inner core layer and the outer core layer. The diameter of the core (the overall core consisting of the inner core layer and the outer core layer is referred to below simply as the "core") is, but is not particularly limited to, preferably at least 32 mm, more preferably at least 35.3 mm, and even more preferably at least 36 mm, with the upper limit being preferably not more than 39 mm, more preferably not more than 38 mm, and even more preferably not more than 37 mm. When the core diameter falls outside of this range, the initial velocity of the ball may decrease or the spin rate-lowering effect on full shot may be inadequate, as a result of which a good distance may not be obtained.

A surface hardness of the core is, in terms of JIS-C hardness, but is not particularly limited to, preferably at least 70, more preferably at least 75, and even more preferably at least 80, with the upper limit being preferably not more than 100, more preferably not more than 95, and even more preferably not more than 93. The core surface hardness may be expressed in terms of Shore D hardness and is preferably at least 45, more preferably at least 49, and even more preferably at least 53, with the upper limit being preferably not more than 68, more preferably not more than 64, and even more preferably not more than 61. When the surface hardness is too low, the resilience may be too low, resulting in a poor distance, or the feel at impact may be too soft, or the durability to cracking under repeated impacts may worsen. In contrast, when the surface hardness is too high, the spin rate may rise excessively, resulting in a poor distance, or the feel at impact may be too hard.

A difference between the surface hardness of the core and a center hardness of the core is, in terms of JIS-C hardness, preferably at least 25, more preferably at least 30, and even more preferably at least 37, with the upper limit being preferably not more than 55, and more preferably not more than 47. This hardness difference may be expressed in terms of Shore D hardness and is preferably at least 19, more preferably at least 23, and even more preferably at least 28, with the upper limit being preferably not more than 42, and more preferably not more than 36. When this hardness difference is too small, the spin rate may be too high, resulting in a poor distance. In contrast, when this difference is too large, the durability under repeated impacts may worsen, or the resilience may become low, resulting in a poor distance.

The inner core layer has a diameter of preferably at least 15 mm, more preferably at least 20 mm, and even more preferably at least 22 mm, with the upper limit being preferably not more than 38 mm, more preferably not more than 37 mm, and even more preferably not more than 36 mm. When the inner core layer diameter falls outside of this range, the initial velocity of the ball may decrease and the spin rate-lowering effect may be inadequate, as a result of which a good distance may not be obtained, or the durability to cracking under repeated impacts may worsen.

The inner core layer has a center hardness, in terms of JIS-C hardness, of preferably at least 33, more preferably at least 38, and even more preferably at least 43, with the upper limit being preferably not more than 63, more preferably not more than 58, and even more preferably not more than 53. The center hardness is, in terms of Shore D hardness, preferably at least 17, more preferably at least 21, and even more preferably at least 25, with the upper limit being preferably not more than 40, more preferably not more than 36, and even more preferably not more than 32. When the core center is too hard, the spin rate may rise excessively, resulting in a poor distance, or the feel at impact may be too hard. In contrast, when the core center is too soft, the resilience may be too low, resulting in a poor distance, or the feel at impact may be soft, or the durability to cracking under repeated impacts may worsen.

A hardness at a position 5 mm from the center of the core is, in terms of JIS-C hardness, preferably at least 36, more preferably at least 41, and even more preferably at least 46, with the upper limit being preferably not more than 66, more preferably not more than 64, and even more preferably not more than 62. Outside this range, the spin rate-lowering effect on full shot may be inadequate, and the resilience may be low, as a result of which a good distance may not be obtained.

A hardness at a position 10 mm from the center of the core is, in terms of JIS-C hardness, preferably at least 41, more preferably at least 46, and even more preferably at least 51, with the upper limit being preferably not more than 71, more preferably not more than 66, and even more preferably not more than 65. Outside this range, the spin rate-lowering effect on full shot may be inadequate, and the resilience may be low, as a result of which a good distance may not be obtained.

A difference between the hardness at a position 10 mm from the center of the core and the center hardness of the core is, in terms of JIS-C hardness, preferably at least 0, more preferably at least 3, and even more preferably at least 5, with the upper limit being preferably not more than 15, and more preferably not more than 11. Outside this range, the spin rate-lowering effect on full shot may be inadequate, and the resilience may be lower, as a result of which a good distance may not be obtained.

A difference between the surface hardness of the core and the hardness at a position 10 mm from the center of the core is, in terms of JIS-C hardness, preferably at least 17, more preferably at least 22, with the upper limit being preferably not more than 50, more preferably not more than 35, and even more preferably not more than 33. Outside this range, the spin rate-lowering effect on full shot may be inadequate, and the resilience may be lower, as a result of which a good distance may not be obtained.

When the difference between the surface hardness of the core and the hardness at a position 10 mm from the core center is symbol A, and the difference between the hardness at a position 10 mm from the core center and the center hardness of the core is symbol B, it is preferable for $A>B$, more preferable for $A>2\times B$, and even more preferable for $A>3\times B$. Outside this range, the spin rate-lowering effect on full shot may be inadequate, and the resilience may be low, as a result of which a good distance may not be obtained. Also, a good feel at impact may not be obtained.

The inner and outer core layers having the surface hardnesses and deflections mentioned above each is composed of materials primarily including a rubber material. The rubber materials used in the inner core layer and the outer core layer for enveloping the inner core layer may be the same or different. Specifically, a rubber composition can be prepared using a base rubber as the primary component and blending with other ingredients such as co-crosslinking agents, organic peroxides, inert fillers, and organosulfur compounds. It is preferable to use polybutadiene as the base rubber.

The core having the two-layer structure may be produced by conventional methods. For example, the inner core layer is formed into a sphere shape by a thermal compression at a temperature of at least 140° C. but not more than 180° C. for a period of at least 10 minutes but not more than 60 minutes. A method for forming the outer core layer on the surface of the inner core layer may involve forming a pair of half-cups from unvulcanized rubber sheets, placing and enclosing the inner core layer within the pair of half-cups, and then molding it by a thermal compression. Preferably, a process in which the vulcanization step is divided into two stages may be employed. For example, a pair of hemispherical cups is formed by initial vulcanization (semi-vulcanization), and then a prefabricated inner core layer is placed in one of the hemispherical cups and is covered with the other hemispherical cup to carry out secondary vulcanization (complete vulcanization). Alternatively, a rubber composition in an unvulcanized state is formed into sheets to produce a pair of outer core layer sheets and is further formed using a mold having a hemispherical protrusion into so as to produce a pair of unvulcanized hemispherical cups, and then, a prefabricated inner core layer is placed in the pair of hemispherical cups to form it into a spherical shape by a thermal compression at a temperature of 140 to 180° C. for a period of 10 to 60 minutes.

The envelope layer in this invention is made primarily of a resin material. The resin material in the envelope layer is, but is not particularly limited to, preferably a material containing a base resin as the essential component. The base resin includes in specific amounts: (a) an olefin-unsaturated carboxylic acid random copolymer and/or a metal ion neutralization product of an olefin-unsaturated carboxylic acid random copolymer, and (b) an olefin-unsaturated carboxylic acid-unsaturated carboxylic acid ester random copolymer and/or a metal ion neutralization product of an olefin-unsaturated carboxylic acid-unsaturated carboxylic acid ester random copolymer. That is, in this invention, by using the materials mentioned above for the envelope layer, the spin rate of the ball on shots with a driver W#1 can be reduced, enabling a long distance to be obtained.

The cover layer material is formed primarily of a known synthetic resin such as a thermoplastic resin or a thermoplastic elastomer. It is especially preferable for the cover layer material to be formed primarily of polyurethane. By using this, it is possible to achieve the desired effects of the invention, that is, to provide a golf ball which is satisfactory both in terms of controllability and scuff resistance thereof.

EXAMPLES

Candidates for oval dimples to be arranged on the surface of the golf ball are illustrated in Table 1. In the dimples illustrated in Table 1, the bottom surface of the dimple on the cross section along the long diameter has an oval arc shape, and the bottom surface of the dimple on the cross section along the short diameter has a circular arc shape. In Table 2, Examples of a golf ball on which the candidates of the oval dimples illustrated in FIG. 1 are arranged in various combinations with one another are shown. For the circular dimples illustrated in the following Tables 2, 4, and 6, diameters (unit: mm) are shown in the item "Type of dimple". The item "Ratio of dimples with 3.7 mm or greater DS" illustrated in the following Tables 2, 4, and 6 is a ratio of oval dimples in which the short diameter DS is 3.7 mm or greater to all the oval dimples.

TABLE 1

| Dimple | DL | DS | DS/DL | DPL | DPS | DLA | DSA | DLA − DSA |
|---|---|---|---|---|---|---|---|---|
| A | 5.0 | 4.95 | 1.01 | 0.153 | 0.156 | 0.6013 | 0.5154 | 0.08596 |
| B | 5.0 | 4.76 | 1.05 | 0.153 | 0.167 | 0.6013 | 0.5301 | 0.07120 |
| C | 5.0 | 4.55 | 1.1 | 0.153 | 0.179 | 0.6013 | 0.5421 | 0.05947 |
| D | 4.7 | 4.65 | 1.01 | 0.120 | 0.123 | 0.4440 | 0.3813 | 0.06268 |
| E | 4.7 | 4.48 | 1.05 | 0.120 | 0.132 | 0.4440 | 0.3953 | 0.04870 |
| F | 4.7 | 4.27 | 1.1 | 0.120 | 0.143 | 0.4440 | 0.4073 | 0.03672 |
| G | 4.5 | 4.46 | 1.01 | 0.111 | 0.113 | 0.3927 | 0.3372 | 0.05551 |
| H | 4.5 | 4.29 | 1.05 | 0.111 | 0.122 | 0.3927 | 0.3493 | 0.04335 |
| I | 4.5 | 4.09 | 1.1 | 0.111 | 0.132 | 0.3927 | 0.3597 | 0.03296 |
| J | 4.3 | 4.26 | 1.01 | 0.111 | 0.114 | 0.3765 | 0.3226 | 0.05381 |
| K | 4.3 | 4.10 | 1.05 | 0.111 | 0.122 | 0.3765 | 0.3322 | 0.04428 |
| L | 4.3 | 3.58 | 1.2 | 0.111 | 0.145 | 0.3765 | 0.3461 | 0.03036 |
| M | 4.2 | 4.16 | 1.01 | 0.126 | 0.129 | 0.4172 | 0.3566 | 0.06063 |
| N | 4.2 | 4.00 | 1.05 | 0.126 | 0.136 | 0.4172 | 0.3633 | 0.05387 |
| O | 4.2 | 3.82 | 1.1 | 0.126 | 0.144 | 0.4172 | 0.3682 | 0.04901 |
| P | 4.0 | 3.96 | 1.01 | 0.106 | 0.108 | 0.3334 | 0.2852 | 0.04814 |
| Q | 4.0 | 3.81 | 1.05 | 0.106 | 0.115 | 0.3334 | 0.2919 | 0.04145 |
| R | 4.0 | 3.64 | 1.1 | 0.106 | 0.122 | 0.3334 | 0.2971 | 0.03628 |
| S | 3.8 | 3.76 | 1.01 | 0.115 | 0.117 | 0.3441 | 0.2936 | 0.05049 |
| T | 3.8 | 3.62 | 1.05 | 0.115 | 0.123 | 0.3441 | 0.2975 | 0.04661 |
| U | 3.8 | 3.45 | 1.1 | 0.115 | 0.130 | 0.3441 | 0.2998 | 0.04431 |
| V | 3.4 | 3.37 | 1.01 | 0.142 | 0.144 | 0.3228 | 0.3226 | 0.00017 |

TABLE 1-continued

| Dimple | DL | DS | DS/DL | DPL | DPS | DLA | DSA | DLA − DSA |
|---|---|---|---|---|---|---|---|---|
| W | 3.4 | 3.24 | 1.05 | 0.142 | 0.149 | 0.3228 | 0.3212 | 0.00164 |
| X | 3.4 | 3.09 | 1.1 | 0.142 | 0.154 | 0.3228 | 0.3179 | 0.00485 |
| Y | 3.2 | 3.17 | 1.01 | 0.080 | 0.081 | 0.2010 | 0.1715 | 0.02948 |
| Z | 3.2 | 3.05 | 1.05 | 0.080 | 0.086 | 0.2010 | 0.1739 | 0.02704 |
| I | 3.2 | 2.91 | 1.1 | 0.080 | 0.090 | 0.2010 | 0.1754 | 0.02552 |
| II | 3.1 | 3.07 | 1.01 | 0.074 | 0.075 | 0.1793 | 0.1531 | 0.02627 |
| III | 3.1 | 2.95 | 1.05 | 0.074 | 0.079 | 0.1793 | 0.1554 | 0.02395 |
| IV | 3.1 | 2.82 | 1.1 | 0.074 | 0.083 | 0.1793 | 0.1569 | 0.02245 |
| V | 2.5 | 2.48 | 1.01 | 0.083 | 0.084 | 0.1637 | 0.1389 | 0.02480 |
| VI | 2.5 | 2.38 | 1.05 | 0.083 | 0.087 | 0.1637 | 0.1379 | 0.02581 |
| VII | 2.5 | 2.27 | 1.1 | 0.083 | 0.090 | 0.1637 | 0.1361 | 0.02757 |

TABLE 2

| Example | Type of dimple | Planar shape | Number | Total number | SR | Aerodynamic isotropy | Air resistance | Ratio of dimples with DS ≥3.7 mm |
|---|---|---|---|---|---|---|---|---|
| 1 | m | Oval | 152 | 272 | 73 | Excellent | Excellent | 100.0 |
| | b | Oval | 60 | | | | | |
| | f | Oval | 60 | | | | | |
| 2 | g | Oval | 12 | 330 | 77 | Excellent | Excellent | 92.7 |
| | j | Oval | 234 | | | | | |
| | s | Oval | 60 | | | | | |
| | VI | Oval | 12 | | | | | |
| | w | Oval | 12 | | | | | |
| 3 | p | Oval | 72 | 392 | 70 | Good | Good | 69.4 |
| | s | Oval | 200 | | | | | |
| | I | Oval | 96 | | | | | |
| | III | Oval | 24 | | | | | |
| 4 | p | Oval | 72 | 392 | 72 | Good | Good | 100.0 |
| | 3.8 | Circular | 200 | | | | | |
| | 3.2 | Circular | 96 | | | | | |
| | 3.1 | Circular | 24 | | | | | |

Candidates of the oval dimples to be arranged on the surface of the golf ball are illustrated in Table 3. In the dimples illustrated in Table 3, the bottom surface of the dimple on the cross section along the long diameter has an oval arc shape, and the bottom surface of the dimple on the cross section along the short diameter has a parabola shape. In Table 4, Examples of a golf ball on which the candidates of the oval dimples illustrated in FIG. 3 are arranged in various combinations with one another are shown.

TABLE 3

| Dimple | DL | DS | DS/DL | DPL | DPS | DLA | DSA | DLA − DSA |
|---|---|---|---|---|---|---|---|---|
| A | 5.0 | 4.95 | 1.01 | 0.153 | 0.156 | 0.6013 | 0.5149 | 0.08637 |
| B | 5.0 | 4.76 | 1.05 | 0.153 | 0.167 | 0.6013 | 0.5296 | 0.07172 |
| C | 5.0 | 4.55 | 1.1 | 0.153 | 0.179 | 0.6013 | 0.5415 | 0.05984 |
| D | 4.7 | 4.65 | 1.01 | 0.120 | 0.123 | 0.4440 | 0.3811 | 0.06289 |
| E | 4.7 | 4.48 | 1.05 | 0.120 | 0.132 | 0.4440 | 0.3950 | 0.04897 |
| F | 4.7 | 4.27 | 1.1 | 0.120 | 0.143 | 0.4440 | 0.4069 | 0.03708 |
| G | 4.5 | 4.46 | 1.01 | 0.111 | 0.113 | 0.3927 | 0.3370 | 0.05569 |
| H | 4.5 | 4.29 | 1.05 | 0.111 | 0.122 | 0.3927 | 0.3491 | 0.04358 |
| I | 4.5 | 4.09 | 1.1 | 0.111 | 0.132 | 0.3927 | 0.3594 | 0.03326 |
| J | 4.3 | 4.26 | 1.01 | 0.111 | 0.114 | 0.3765 | 0.3225 | 0.05399 |
| K | 4.3 | 4.10 | 1.05 | 0.111 | 0.122 | 0.3765 | 0.3319 | 0.04451 |
| L | 4.3 | 3.58 | 1.2 | 0.111 | 0.145 | 0.3765 | 0.3456 | 0.03081 |
| M | 4.2 | 4.16 | 1.01 | 0.126 | 0.129 | 0.4172 | 0.3563 | 0.06090 |
| N | 4.2 | 4.00 | 1.05 | 0.126 | 0.136 | 0.4172 | 0.3630 | 0.05421 |
| O | 4.2 | 3.82 | 1.1 | 0.126 | 0.144 | 0.4172 | 0.3678 | 0.04943 |
| P | 4.0 | 3.96 | 1.01 | 0.106 | 0.108 | 0.3334 | 0.2851 | 0.04830 |
| Q | 4.0 | 3.81 | 1.05 | 0.106 | 0.115 | 0.3334 | 0.2917 | 0.04166 |
| R | 4.0 | 3.64 | 1.1 | 0.106 | 0.122 | 0.3334 | 0.2968 | 0.03655 |
| S | 3.8 | 3.76 | 1.01 | 0.115 | 0.117 | 0.3441 | 0.2934 | 0.05071 |
| T | 3.8 | 3.62 | 1.05 | 0.115 | 0.123 | 0.3441 | 0.2972 | 0.04689 |
| U | 3.8 | 3.45 | 1.1 | 0.115 | 0.130 | 0.3441 | 0.2994 | 0.04465 |
| V | 3.4 | 3.37 | 1.01 | 0.142 | 0.144 | 0.3798 | 0.3222 | 0.05760 |
| W | 3.4 | 3.24 | 1.05 | 0.142 | 0.149 | 0.3798 | 0.3206 | 0.05913 |

TABLE 3-continued

| Dimple | DL | DS | DS/DL | DPL | DPS | DLA | DSA | DLA − DSA |
|---|---|---|---|---|---|---|---|---|
| X | 3.4 | 3.09 | 1.1 | 0.142 | 0.154 | 0.3798 | 0.3173 | 0.06244 |
| Y | 3.2 | 3.17 | 1.01 | 0.080 | 0.081 | 0.2010 | 0.1714 | 0.02957 |
| Z | 3.2 | 3.05 | 1.05 | 0.080 | 0.086 | 0.2010 | 0.1738 | 0.02715 |
| I | 3.2 | 2.91 | 1.1 | 0.080 | 0.090 | 0.2010 | 0.1753 | 0.02566 |
| II | 3.1 | 3.07 | 1.01 | 0.074 | 0.075 | 0.1793 | 0.1530 | 0.02635 |
| III | 3.1 | 2.95 | 1.05 | 0.074 | 0.079 | 0.1793 | 0.1553 | 0.02404 |
| IV | 3.1 | 2.82 | 1.1 | 0.074 | 0.083 | 0.1793 | 0.1568 | 0.02256 |
| V | 2.5 | 2.48 | 1.01 | 0.083 | 0.084 | 0.1637 | 0.1388 | 0.02493 |
| VI | 2.5 | 2.38 | 1.05 | 0.083 | 0.087 | 0.1637 | 0.1378 | 0.02596 |
| VII | 2.5 | 2.27 | 1.1 | 0.083 | 0.090 | 0.1637 | 0.1360 | 0.02774 |

TABLE 4

| Example | Type of dimple | Planar shape | Number | Total number | SR | Aerodynamic isotropy | Air resistance | Ratio of dimples with DS ≥3.7 mm |
|---|---|---|---|---|---|---|---|---|
| 5 | m | Oval | 152 | 272 | 70 | Excellent | Excellent | 100.0 |
| | b | Oval | 60 | | | | | |
| | f | Oval | 60 | | | | | |
| 6 | g | Oval | 12 | 330 | 74 | Excellent | Excellent | 92.7 |
| | j | Oval | 234 | | | | | |
| | s | Oval | 60 | | | | | |
| | VI | Oval | 12 | | | | | |
| | w | Oval | 12 | | | | | |
| 7 | g | Oval | 12 | 330 | 73 | Good | Good | 21.8 |
| | L | Oval | 234 | | | | | |
| | S | Oval | 60 | | | | | |
| | VI | Oval | 12 | | | | | |
| | w | Oval | 12 | | | | | |
| 8 | g | Oval | 12 | 330 | 77 | Good | Good | 33.3 |
| | 4.3 | Circular | 234 | | | | | |
| | 3.8 | Circular | 60 | | | | | |
| | VI | Oval | 12 | | | | | |
| | W | Oval | 12 | | | | | |

Figure 5:
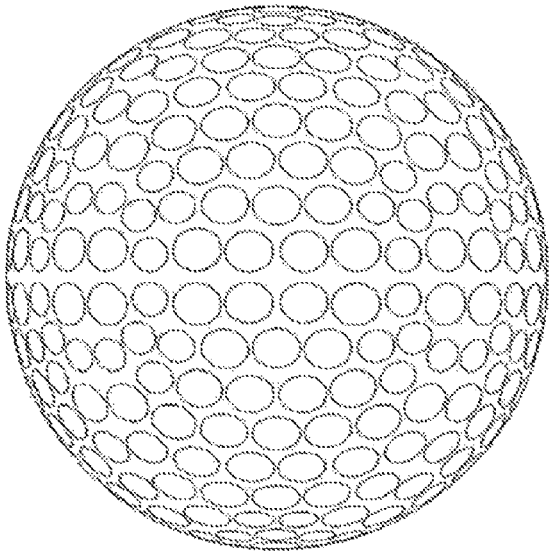
FIG. 5 is a front view showing an embodiment of a golf ball according to the present invention.
Figure 6:
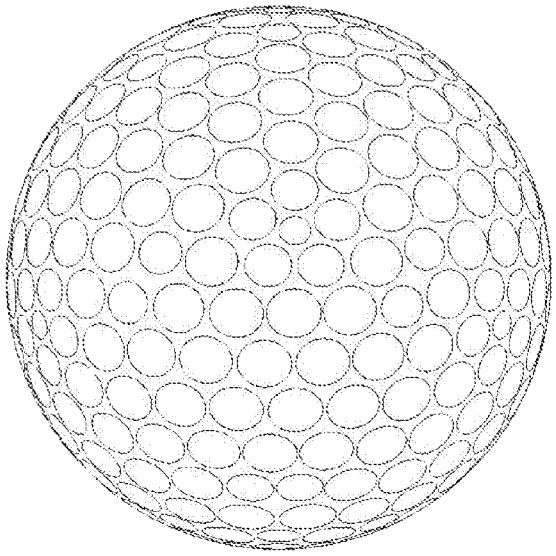
FIG. 6 is a front view showing an embodiment of a golf ball according to the present invention.
Figure 7:
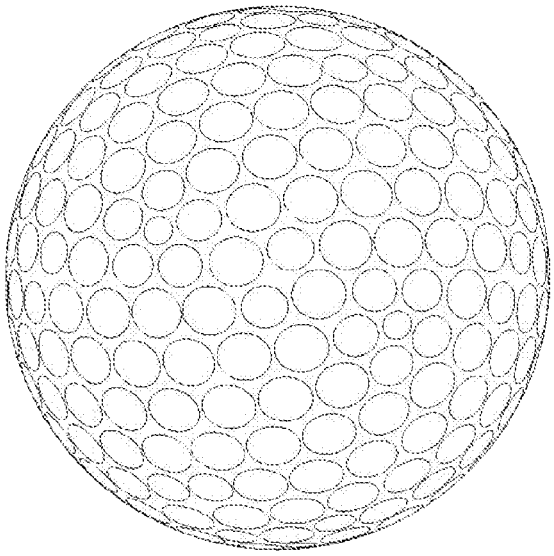
FIG. 7 is a front view showing an embodiment of a golf ball according to the present invention.
Figure 8:
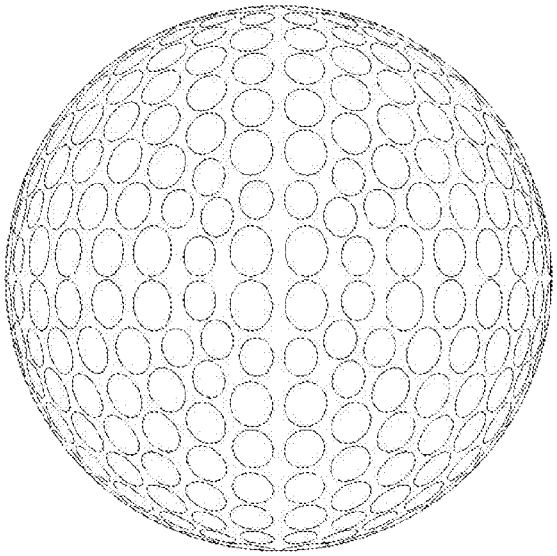
FIG. 8 is a front view showing an embodiment of a golf ball according to the present invention.
Figure 9:
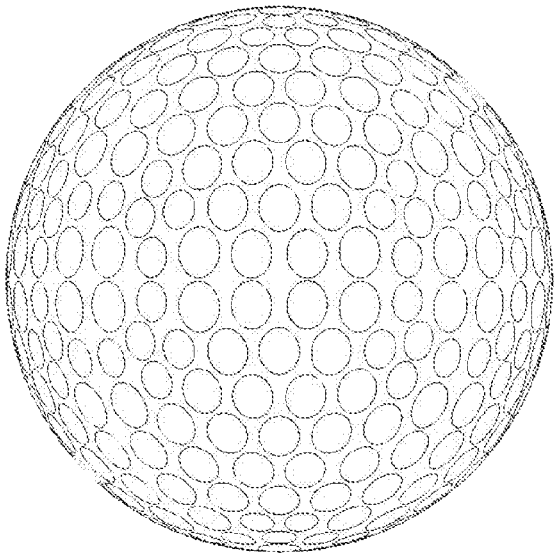
FIG. 9 is a front view showing an embodiment of a golf ball according to the present invention.
Figure 10:
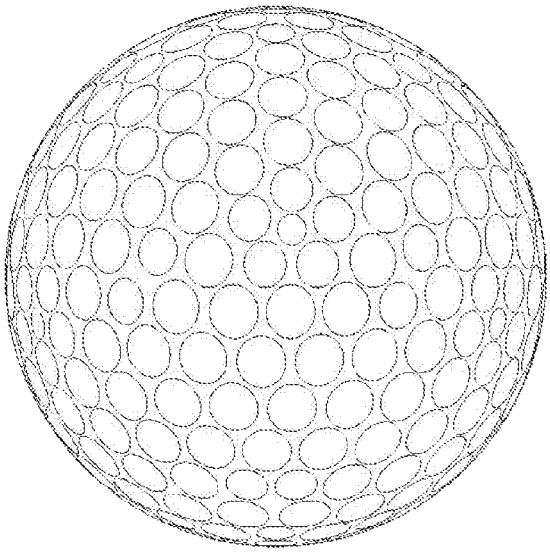
FIG. 10 is a front view showing an embodiment of a golf ball according to the present invention.
Figure 11:
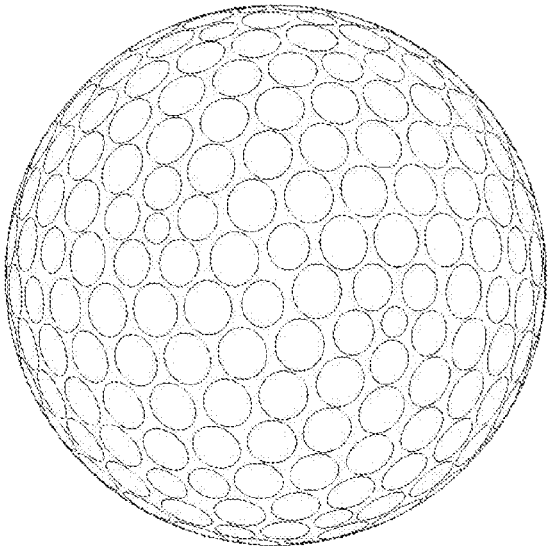
FIG. 11 is a front view showing an embodiment of a golf ball according to the present invention.

On the other hand, candidates of the oval dimples to be arranged on the surface of the golf ball according to Comparative Examples are illustrated in Table 5. In the dimples illustrated in Table 5, both the dimple bottom surfaces on the cross sections along the long diameter and the short diameter have an oval arc shape. In Table 6, Comparative Examples of a golf ball on which the candidates of the oval dimples illustrated in FIG. 5 are arranged in various combinations with one another are shown. For the golf balls according to both Examples and Comparative Examples, the oval dimples were arranged so that the diameters of the oval dimples were in parallel with the equator of the golf ball.

TABLE 5

| Dimple | DL | DS | DS/DL | DPL | DPS | DLA | DSA | DLA − DSA |
|---|---|---|---|---|---|---|---|---|
| A | 4.50 | 3.60 | 1.25 | 0.111 | 0.154 | 0.3335 | 0.3701 | −0.0366 |
| B | 4.30 | 3.44 | 1.25 | 0.111 | 0.151 | 0.3197 | 0.3459 | −0.0262 |
| C | 4.00 | 3.20 | 1.25 | 0.116 | 0.149 | 0.3099 | 0.3205 | −0.0106 |
| D | 3.80 | 3.04 | 1.25 | 0.115 | 0.145 | 0.2923 | 0.2961 | −0.0038 |

TABLE 5-continued

| Dimple | DL | DS | DS/DL | DPL | DPS | DLA | DSA | DLA − DSA |
|---|---|---|---|---|---|---|---|---|
| F | 3.20 | 2.56 | 1.25 | 0.080 | 0.102 | 0.1707 | 0.1736 | −0.0029 |
| G | 3.10 | 2.48 | 1.25 | 0.074 | 0.094 | 0.1523 | 0.1555 | −0.0032 |

TABLE 6

| Comparative example | Type of dimple | Planar shape | Number | Total number | SR | Aerodynamic isotropy | Air Resistance | Ratio of dimples with DS ≥3.7 mm |
|---|---|---|---|---|---|---|---|---|
| 1 | C | Oval | 72 | 392 | 58 | Worst | Worst | 0 |
| | D | Oval | 200 | | | | | |
| | F | Oval | 96 | | | | | |
| | G | Oval | 24 | | | | | |
| 2 | A | Oval | 12 | 330 | 62 | Worst | Worst | 0 |
| | B | Oval | 234 | | | | | |
| | D | Oval | 60 | | | | | |
| | 2.5 | Circular | 12 | | | | | |
| | E | Oval | 12 | | | | | |
| 3 | C | Oval | 72 | 392 | 68 | Inferior | Worst | 0 |
| | 3.8 | Circular | 200 | | | | | |
| | 3.2 | Circular | 96 | | | | | |
| | G | Oval | 24 | | | | | |
| 4 | A | Oval | 12 | 330 | 74 | Inferior | Worst | 0 |
| | 4.3 | Circular | 234 | | | | | |
| | D | Oval | 60 | | | | | |
| | 2.5 | Circular | 12 | | | | | |
| | E | Oval | 12 | | | | | |

For the golf balls of the Examples and Comparative Examples, simulations were carried out to examine the aerodynamic isotropy and the level of reduction of the air resistance. Results of these simulations are shown in Tables 2, 4, and 6. For evaluation of the air resistance reduction level, a golf ball hitting robot was fitted with a driver W#1, sample golf balls were hit by the robot at the head speed of 43 m/s, the flight distances of the balls were measured, the standard deviation of the flight distances of 10 hits of the ball was calculated, and the evaluation was made on the basis of the calculated standard deviation. In the Tables, the evaluation result "Excellent" corresponds to the standard deviation of 3.0 m or less, "Good" corresponds to the standard deviation of over 3.0 m to 5.0 m, "Inferior" corresponds to the standard deviation of over 5.0 m to 7.0 m, and "Worst" corresponds to the standard deviation of over 7.0 m.

For evaluation of the aerodynamic isotropy, the golf ball hitting robot was equipped with the driver W#1, sample golf balls were hit by the robot at the head speed of 43 m/s, the horizontal distances between the falling points of the balls and the reference line (a normal line from the hitting point) were measured, the standard deviation of the distances of 10 hits of the ball was calculated, and the evaluation was made on the basis of the calculated standard deviation. In the Tables, the evaluation result "Excellent" corresponds to the standard deviation of 3.0 m or less, "Good" corresponds to the standard deviation of over 3.0 m to 6.0 m, "Inferior" corresponds to the standard deviation of over 6.0 m to 9.0 m, and "Worst" corresponds to the standard deviation of over 9.0 m.

As shown in Table 6, the dimples formed on the surface of the golf balls of Comparative Examples each had a long diameter DL longer than a short diameter DS by more than 1.2 times, and the cross-sectional area DLA on the cross section along the long diameter DL was smaller than the cross-sectional area DSA on the cross section along the short diameter DS. As a result, the aerodynamic isotropy and the air resistance reduction did not reach specified levels.

On the other hand, as shown in Tables 2 and 4, the dimples formed on the surface of the golf balls of the Examples had a long diameter DL longer than a short diameter DS by 1.2 times or less, and the cross-sectional area DLA on the cross section along the long diameter DL was larger than the cross-sectional area DSA on the cross section along the short diameter DS. As a result, excellent aerodynamic isotropy was obtained and air resistance was superiorly reduced.

In particular in Examples 1, 2, 5, and 6 in which the ratio of the oval dimples with the short diameter DS of 3.7 mm or longer was 90% or higher, the dimple surface occupation ratios SR were 70% or higher with the small number of dimples N, and thereby superior aerodynamic isotropy was obtained and air resistance was superiorly reduced.

In Examples 4 and 8, in which circular dimples were used in combination with the oval dimples, the ratio of the dimples with the specific oval shape was respectively 18% or higher and 10% or higher. As a result, excellent aerodynamic isotropy was obtained and air resistance was superiorly reduced.

What is claimed is:

1. A golf ball comprising oval dimples arranged on a surface thereof, each of the oval dimples having a long diameter DL and a short diameter DS in a planar shape thereof, each of the oval dimples further having a depth DPL on a first cross section of the oval dimple along the long diameter DL and a depth DPS on a second cross section of the oval dimple along the short diameter DS, the depth DPL being a distance taken on the first cross section along the long diameter DL from a first line connecting both ends of the first cross section of the oval dimple to a deepest point of a dimple bottom surface, the depth DPS being a distance taken on the second cross section along the short diameter DS from a second line connecting both ends of the second cross section of the oval dimple to a deepest point of a dimple bottom surface, a relationship between the depth DPL and the depth DPS being defined as a following formula (1):

$$DPS > DPL \quad (1),$$

each of the oval dimples further having a cross-sectional area DLA on the first cross section of the oval dimple along the long diameter DL and a cross-sectional area DSA on the second cross section of the oval dimple along the short diameter DS, the cross-sectional area DLA being surrounded by the first line connecting both ends of the first cross section of the oval dimple and the bottom surface thereof, the cross-sectional area DSA being surrounded by the second line connecting both ends of the second cross section of the oval dimple and the bottom surface thereof, a relationship between the cross-sectional area DLA and the cross-sectional area DSA being defined as a following formula (2):

$$DLA \geq DSA \quad (2), \text{ and}$$

a surface coverage SR of all dimples on the surface of the golf ball being at least 70%.

2. The golf ball according claim 1, wherein the relationship between the depth DPL and the depth DPS being defined as in following formula (3):

$$DPS > DPL \times 1.02 \quad (3).$$

3. The golf ball according to claim 1, wherein a relationship between the long diameter DL and the short diameter DS being defined as a following formula (4):

$$DL \leq DS \times 1.2 \quad (4).$$

4. The golf ball according claim 1, wherein a relationship between the long diameter DL and the short diameter DS is defined as in following formula (5):

$$DL \leq DS \times 1.15 \quad (5).$$

5. The golf ball according to claim 1, wherein the oval dimples are arranged so that the long diameter of the oval dimple is in parallel or perpendicular to an equator of the golf ball.

6. The golf ball according to claim 1, wherein the short diameter DS of the oval dimples is at least 3.7 mm.

7. The golf ball according to of claim 1, wherein the bottom surface of the oval dimple on the first cross section along the long diameter DL has an oval shape, and wherein the bottom surface of the oval dimple on the second cross section along the short diameter DS has a circular or parabola shape.

8. The golf ball according to claim 1, wherein a volume ratio VR of all dimples in the golf ball is in a range of 0.85 to 1.7%.

9. The golf ball according to claim 1, wherein a ratio of the number of the oval dimples to the total number of all dimples arranged on the golf ball is at least 10%.

10. The golf ball according to claim 6, wherein at least one oval dimple is arranged in a first range of latitude of 0 to 30°, a second range of latitude of 30 to 60°, and a third range of latitude of 60 to 90°, respectively, where 0° is taken at an equator of the golf ball.

* * * * *